United States Patent [19]

Laurin

[11] Patent Number: 4,461,597

[45] Date of Patent: Jul. 24, 1984

[54] VALVE BOX COVER

[76] Inventor: Gerard F. Laurin, 110 Hemlock Ter., Augusta, Me. 04330

[21] Appl. No.: 489,020

[22] Filed: Apr. 27, 1983

[51] Int. Cl.[3] ..... E02D 29/14

[52] U.S. Cl. ..... 404/25; 52/20; 137/371; 138/89; 220/235; 292/256.67; 292/260; 292/DIG. 72

[58] Field of Search ..... 404/25, 26; 137/371, 137/364; 52/19, 20, 21; 210/163, 164, 165, 166; 220/235, 233; 292/260, 256.67, DIG. 72; 138/89

[56] References Cited

U.S. PATENT DOCUMENTS

| | | | |
|---|---|---|---|
| 135,822 | 2/1873 | LaForge | 137/371 |
| 289,663 | 12/1883 | Langill | 404/25 |
| 458,525 | 8/1891 | Farlow | 292/DIG. 72 |
| 969,881 | 9/1910 | Klemm | 137/371 |
| 1,229,429 | 10/1917 | Farley | 137/371 |
| 3,051,200 | 8/1962 | Bevington | 220/235 X |
| 3,550,635 | 12/1970 | Schroer | 220/235 X |

FOREIGN PATENT DOCUMENTS

| | | | |
|---|---|---|---|
| 148398 | 3/1904 | Fed. Rep. of Germany | 220/235 |

*Primary Examiner*—Ernest R. Purser
*Assistant Examiner*—Beverly E. Hjorth
*Attorney, Agent, or Firm*—William Nitkin

[57] ABSTRACT

A cover capable of being both locked in position within a valve box or manhole cover and lifted upwards to assist in its removal, having a rotating bolt therein which maneuvers a lever base upwards or downwards which lever base causes the rotation of a lock lift lever extending through a slot in the side of the cover and which, when moved downwards, causes the lock member portion of the lock lift lever to tighten against the valve box and which when raised, rotates a lift member portion against the seat of the valve box thereby jacking the cover upwards so that it can be easily removed.

15 Claims, 4 Drawing Figures

VALVE BOX COVER

BACKGROUND OF THE INVENTION

1. Field of the Invention

The device of this invention resides in the area of locking covers for valve boxes, and more particularly relates to a locking cover including means to assist in jacking the cover out of the valve box to gain access to buried water, gas, petroleum and other process valve operating devices.

2. History of the Prior Art

Locking covers are well known in the prior art as seen in the following U.S. Pat. Nos.:

135,822, 2/18/73, Laforge
969,766, 9/1910, Foley
969,881, 9/1910, Klemm
1,458,391, 6/1923, Burton The Laforge patent is typical of these locking covers having extended radially-spaced fingers which, upon rotation of a central bolt in one direction, tighten against the sides of the valve box to lock the cover in place and upon rotation in the other direction, move the radially-spaced fingers away from the valve box to release the cover.

SUMMARY OF THE INVENTION

It is an object of this invention to provide a locking cover which includes means to raise the cover out of the valve box.

The device of this invention includes a central bolt which, upon rotation, moves a lever base downward and pivots and lock member portion of a lock lift lever against the sides of the valve box to hold the cover tightly in place. When one rotates the bolt in the opposite direction, the lock member portion of the lock lift lever is moved away from the side of the valve box; and the lift member portion of the lock lift lever, pivoting on a portion of the cover, is forced against the seat of the valve box thereby raising the cover in the valve box so it can be easily removed. This raising of the cover the valve box is very advantageous especially in areas where it is difficult to remove the covers from the valve boxes, for example if they are stuck in place due to impacted dirt, bituminous material or ice around the rim of the cover. Single lock lift lever structures can be used individually or in an array around the perimeter of larger manhole covers. In such uses the bolt is not centrally located but is located near the edge of the cover. It would be desirable to use more than one lock lift lever structure on a large cover such as three arrayed equidistant from one another around the perimeter.

DESCRIPTION OF THE PREFERRED EMBODIMENT(S)

Figure 1:
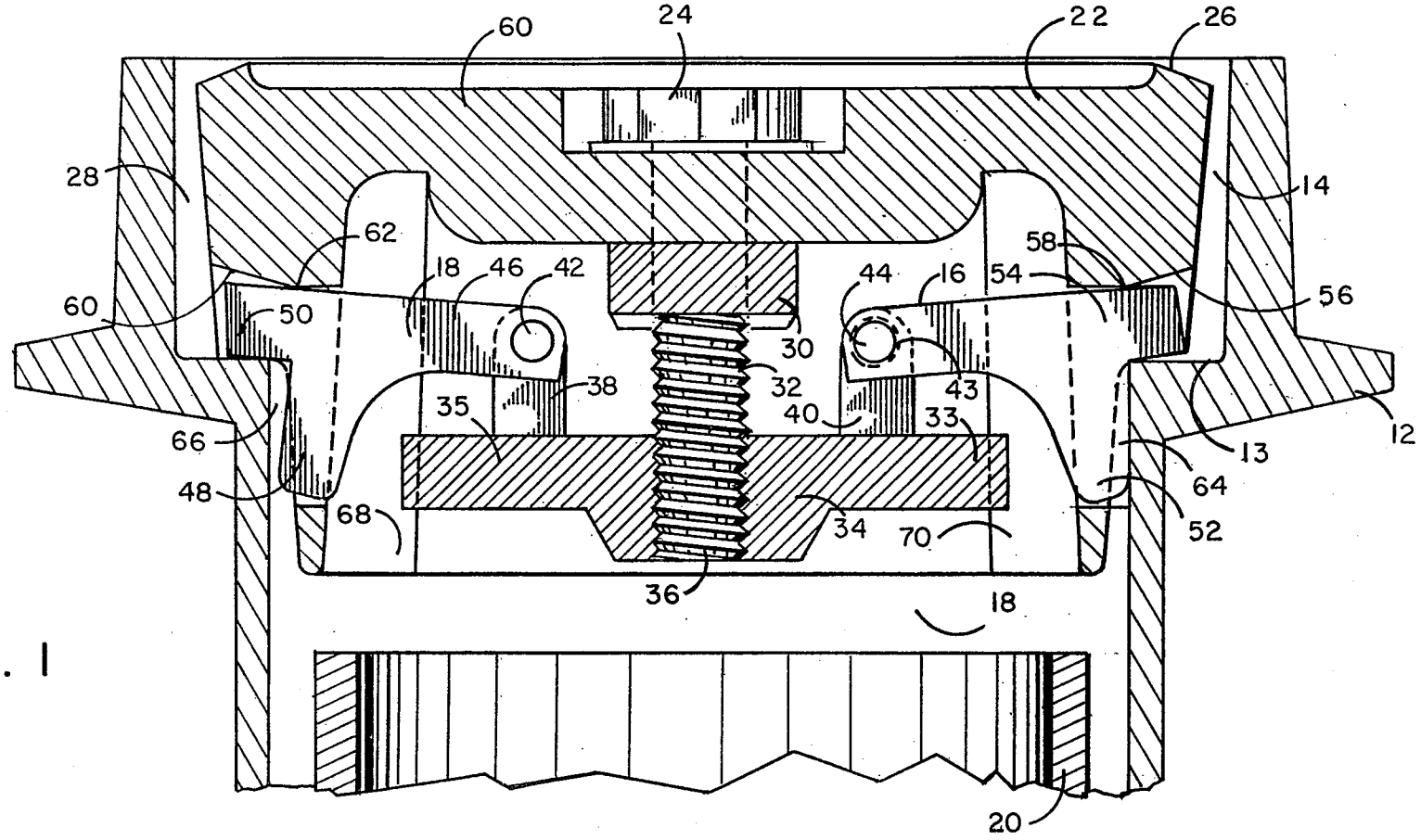
FIG. 1 is a cross-sectional view through a valve box containing the cover of this invention.
Figure 4:
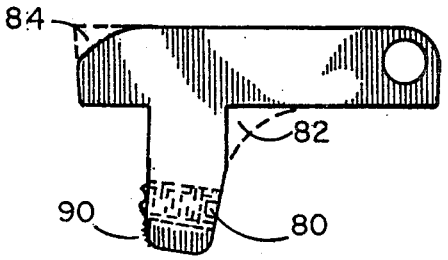
FIG. 4 is a view of an alternate embodiment of a lock lift lever.

Seen in FIG. 1 is a cross-sectional view of a valve box showing the structure of this invention. Valve box 12 is seen with its cover seat 13 in which standard covers are usually placed. Illustrated is cover 22 of this invention. At the top of the cover is head 24 of bolt 32 which head, when turned, rotates threaded bolt 32. Threaded bolt 32 can have a right or left handed thread. The head is counter-sunk into the top as is standard in the art in order to be out of the way. The bolt can be stainless steel, brass or equivalent material and has a plastic or inert material washer under its head between it and cover 22 to assist in preventing electrolysis. The washer should be wider than the head to assist in keeping foreign materials from getting between the bolt head and the cover and to eliminate friction that might occur if the bolt head were directly contacting cover 22 so that the bolt can be rotated easily. The upper outer edges 26 of the cover 22 are beveled downward to prevent the cover from being struck by snow plows and the like and damaged. Thrust collar 30 can be positioned below cover 22 and affixed to bolt 32. This collar assists in retaining bolt 32 in a fixed position while it rotates. In alternative embodiments one can weld thrust collar 30 to bolt 32 or drill laterally through both thrust collar 30 and bolt 32 and place a pin or bolt therethrough to securely lock operating bolt 32 rotatably within cover 22. When the head 24 of operating bolt 32 is rotated in a counterclockwise direction, a lever base 34 is raised thereby as operating bolt 32 is screwed into threaded aperture 36 in a central portion of lever base 34. Lever base 34 extends to two radially opposing sides by side extensions 33 and 35. In the single lock lift lever embodiment for use on large covers, the lever base would only extend to one side and would carry only one lock lift member. Affixed to each side extension are identical structures, one of which is described below. Lever support 40 is affixed to the top of side extension 33 and includes aperture 39 to receive pin member 44 on which rotates lock lift member 16. Lock lift member 16 extends radially outwards through slot 64 formed in the side of cover 22. Lock lift member 16 has two active portions, a lift member portion 54 which extends substantially straight out from pin member 44 through slot 64 and is adapted to rest upon seat 13 of the valve box. Extending downward from the lift member portion 54 perpendicularly thereto is lock member portion 52 which also extends through slot 64. At the top of slot 64 pivot 58 is formed within cover 22, and an angle movement space 56 is defined in the cover extending from pivot 58 and beveling upward to the edge of cover 22. Angle movement space 56 allows movement of the lift member portion and assembly of this device as will be described below. Guides 68 and 70 as seen in FIG. 1 are formed as part of cover 22 on either side of the lock lift levers 16 and 18 and prevent lateral movement thereof. The lock lift lever may include a set screw 80 as seen in FIG. 4 to be set at different extensions from lock member portion 52 to accomodate valve boxes of above-normal tolerances in diameter.

When operating bolt 32 is rotated, the lever base, depending upon the direction of rotation, is either raised or lowered. If it is lowered, the cover is locked in place as the lever supports are lowered and the lock lift levers 16 and 18 pivot on pins 42 and 44 causing lock member portions 48 and 52 to be forced against the sides of the valve box. When the rotation raises the lever base, lock member portions 52 and 48 of the lock lift lever are rotated away from the side of the valve box and lift member portions 50 and 54 of the lock lift levers pivot on pivots 58 and 62 and force downward on cover seat 13 of the valve box thereby forcing the cover upwards from the valve box. Angle movement space 56 allows lift member portion 54 to rise up while the lock member portion 52 contacts the sides of valve box 12. Angle movement space 56 also assists in assembly of the device as the lever base with lock lift members can be inserted directly in the cover with the lock lift levers passing up into the slots and the angle movement spaces.

Figure 2:
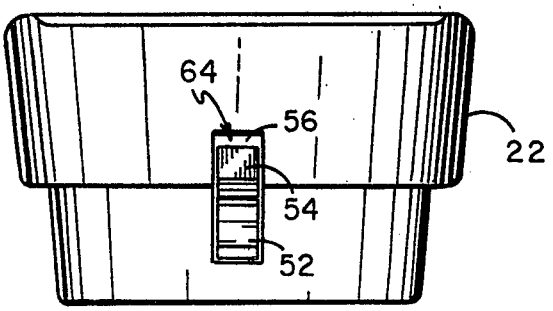
FIG. 2 is a side view of the cover of this invention

FIG. 2 is a side exterior view of the cover showing slot 64 through which protrudes lift member portion 54 and lock member portion 52 of lock lift lever 51. Seen also in this view is the opening forming the angle movement space 56.

Figure 3:
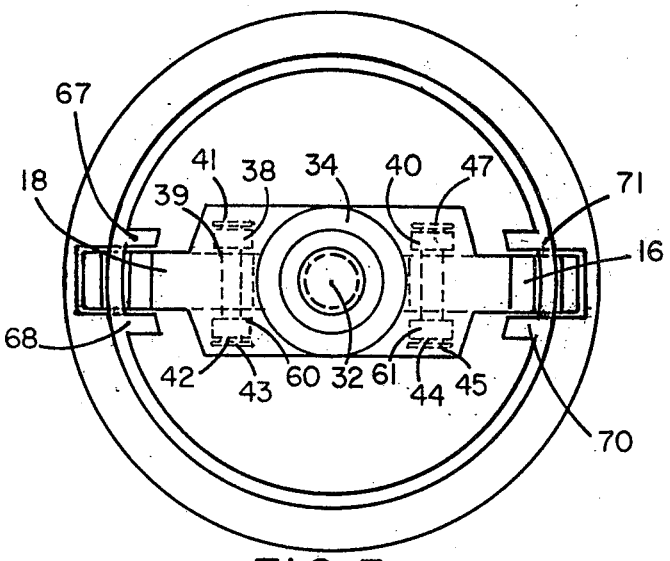
FIG. 3 is a bottom view of the cover of this invention.

FIG. 3 illustrates a bottom view of the cover of this invention showing further details of lever base 34. Guides 67, 68, 70 and 71 which, as discussed above, are formed as part of cover 22 and prevent any lateral movement of the lock lift structure. Lever base 34 is seen riding on operating bolt 32, and the attachment of lock lift members 16 and 18 to the lever supports 38, 40, 60 and 61 is seen with pin members 44 and 42 being held by retainer members 41, 43, 45 and 47. These retainer members can also take the form of nuts and bolts, cottered bolts or roll pins.

FIG. 4 illustrates an alternate embodiment of the lock lift lever having set screw 80 in place therein allowing the outer facing edge of the lock member portion to be extended by rotating the set screw so that it protrudes outwardly from the lock member portion. The use of this set screw may be necessary in some valve boxes which are wider than the normal parameters of movement of the lock lift levers. Also seen in this embodiment is the rounding of the upper portion 84 of the lift member portion of the lock lift lever to allow for more upwards movement within the angle movement spaces 56 and 60 as seen in FIG. 1 and further having a more cutaway section 82 at the junction between the lock member portion and lift member portion of the lock lift lever to allow the lock lift lever further downward movement room to avoid premature contact with the lever base. The part of the lock lift lever at the point of contact between the lock lift lever and the valve box can have serrations 90 to assist in frictional lock therebetween.

Although the present invention has been described with reference to particular embodiments, it will be apparent to those skilled in the art that variations and modifications can be substituted therefor without departing from the principles and spirit of the invention.

I claim:

1. A cover of the type used in a valve box, manhole or the like of the type providing a cover seat comprising:

a rotatable bolt located within said cover;

a lever base threadedly engaged on said bolt under said cover and adapted to be raised or lowered upon alternate-direction rotation of said bolt;

at least one pivoting attachment means affixed to said lever base;

at least one slot defined within the side of said cover;

a lock lift lever pivotally attached to said pivoting attachment means on said lever base and extending through said slot;

a lift member portion formed as the upper part of said lock lift lever, the lift member portion being adapted to extend through said slot and to extend over the seat of said valve box; and a lock member portion formed as the lower part of said lock lift lever, the lock member portion extending perpendicularly downward from said lift member portion and also being adapted to extend through said slot when said bolt is rotated and the lever base is lowered, thereby causing said lock member portion to be forced against an interior wall portion of said valve box to lock said cover in place, rotation of the bolt in the opposite direction acting to raise said lever base and to rotate said lock lift lever, thereby forcing said lift member portion downward against the seat of said valve box and said lock member portion away from the interior wall portion of said valve box to raise said cover from the seat upon which it rests and to unlock the cover.

2. The device of claim 1 wherein said bolt is centrally located within said cover and said bolt includes a head which is countersunk in said cover.

3. The device of claim 2 and further comprising at least one additional lock lift member located on a radii from said central bolt extending through a like number of slots defined in said cover.

4. The device of claim 1 and further comprising a pivot point in said cover inward of the top of said slot, said pivot point for applying leverage in the top of said cover; and an angle movement space defined in said cover extending outward from said pivot point to said slot, said angle movement space adapted to allow room for upward movement of the lift member portion of said lock lift lever when said cover is locked in a valve box.

5. The device of claim 1 and further comprising guide members located on either side of said lock lift lever member to prevent lateral movement thereof while allowing for vertical movement.

6. The device of claim 1 and further comprising set screw means in the lock member portion of the lock lift lever adapted to be extended beyond said lock member portion for use in out-of-tolerance valve boxes.

7. Apparatus for covering the opening of a valve box, manhole or similar structure having a cover seat, comprising:

a cover having portions which contact the cover seat for substantially covering the opening of the valve box, the cover having at least one slot formed therein in juxtaposition to the cover seat of the valve box and interior wall portions of said valve box proximate to said cover seat; and locking and unlocking means carried by the cover and having at least a portion extending externally of the valve box to allow manipulation of said means from externally of the valve box for locking the cover on manipulation of said means in a first direction and for unlocking and lifting the cover on manipulation of said means in a second direction, the locking and unlocking means comprising:

a bolt carried by and extending through the cover and adapted for rotation from externally of the valve box, the bolt having a threaded end portion disposed internally of the valve box;

lever base means received on the threaded end portion of the bolt for reciprocating movement along the bolt on rotation of said bolt;

mounting means carried by the lever base means for mounting portions internal of said valve box of the locking and unlocking means to said lever base means; and lock lift lever means having a first portion mounted to the mounting means for movement of the lock lift lever means relative to said mounting means, the lock lift lever means having a lift member portion spaced from said first portion and extending at least partially through the slot formed in the cover plate for contacting the seat cover of the valve box, the lock lift lever means further having a lock member portion disposed adjacent to and spaced from the lift member portion in facing relation to the interior wall portions of the valve box proximate to the seat cover and extending at least partially through the slot formed in the cover for contacting the interior wall portions of the valve box and thereby locking the apparatus in covering relation to the valve box on rotation of the bolt in a sense which increases the spacing between the lever base means and the cover, thereby to force surfaces of the lock member portion against said interior wall portions of the valve box, rotation of the bolt in the opposite sense acting to decrease the spacing between the lever base means and the cover, thereby both to displace the lock member portions away from the interior wall portions of the valve box and thus to unlock the cover and also to force the lift member portion against the seat cover of the valve box to lift the cover from the cover seat.

8. The apparatus of claim 7 wherein the mounting means mount the first portion of the lock lift lever means for pivotal movement of said lock lift lever means.

9. The apparatus of claim 7 wherein a plurality of slots are formed in the cover about the periphery of said cover and wherein the lock lift lever means comprise a plurality of lock lift lever elements, each of said lock lift lever elements being associated with one of the slots.

10. The apparatus of claim 9 wherein each lock lift lever element comprises an elongated body member with one end being pivotally mounted to the mounting means and with the opposite end contacting the cover seat, the lock lift lever element further having a depending leg disposed nearmost said opposite end of the body member and facing the interior wall surfaces of the valve box, rotation of the lock lift lever element in a sense which pivotally displaces the leg away from the lever base means acting to lock the cover over the valve box, and rotation of the lock lift lever element in an opposite sense acting to unlock the cover and to lift the cover from the cover seat of the valve box.

11. The apparatus of claim 10 wherein a portion of the cover defining each of the slots and surmounting the end of the lock lift lever element extending into the slot is contiguous to and contacts an upper surface portion of the lock lift lever element to form a pivot bearing for applying leveraged force to the cover.

12. The apparatus of claim 11 wherein walls of the slots surmounting the lock lift lever element extend at an angle from the pivot bearing and into an increasingly spaced relation to surfaces to the lock lift lever element to define an angle movement space for allowance of movement of the opposite end of the lock lift lever element on pivoting movement of said element into a locking relation with the valve box.

13. The apparatus of claim 12 and further comprising guide means mounted to the cover about each slot for preventing lateral movement of the lock lift lever element.

14. The apparatus of claim 10 and further comprising adjustment means carried by the leg of the lock lift lever element for selectively extending the effective outer surface of the leg in opposition to the interior wall surfaces of the valve box, thereby to accommodate and allow locking of the cover to valve boxes which are dimensioned beyond standard tolerance.

15. The apparatus of claim 14 wherein the adjustment means comprises a set screw carried in the leg and having the distal end thereof extending toward the interior wall portions of the valve box.

* * * * *